US011998793B1

(12) United States Patent
Harrison, II

(10) Patent No.: US 11,998,793 B1
(45) Date of Patent: Jun. 4, 2024

(54) DETACHABLE STRENGTH TRAINING DEVICE FOR LINEMEN AND OTHER ATHLETES

(71) Applicant: David L. Harrison, II, Charlotte, NC (US)

(72) Inventor: David L. Harrison, II, Charlotte, NC (US)

( * ) Notice: Subject to any disclaimer, the term of this patent is extended or adjusted under 35 U.S.C. 154(b) by 98 days.

(21) Appl. No.: 17/562,716

(22) Filed: Dec. 27, 2021

Related U.S. Application Data

(60) Provisional application No. 63/130,627, filed on Dec. 25, 2020.

(51) Int. Cl.

| | |
|---|---|
| ***A63B 21/00*** | (2006.01) |
| ***A63B 21/04*** | (2006.01) |
| ***A63B 21/072*** | (2006.01) |
| ***A63B 69/00*** | (2006.01) |

(52) U.S. Cl.
CPC ..... *A63B 21/4035* (2015.10); *A63B 21/0442* (2013.01); *A63B 21/0728* (2013.01); *A63B 69/002* (2013.01); *A63B 2243/007* (2013.01)

(58) Field of Classification Search
CPC ..... A63B 21/4035; A63B 21/0442; A63B 21/0728; A63B 69/002; A63B 2243/007
See application file for complete search history.

(56) References Cited

U.S. PATENT DOCUMENTS

| | | | | |
|---|---|---|---|---|
| 4,944,509 | A * | 7/1990 | Snider | A63B 21/065 482/105 |
| 5,167,600 | A * | 12/1992 | Baird | A63B 21/065 482/93 |
| 5,713,823 | A * | 2/1998 | Walendzak | A63B 22/18 482/141 |
| 8,951,170 | B1 * | 2/2015 | Tayo | A63B 21/0728 482/139 |
| 9,975,024 | B1 * | 5/2018 | Potter | A63B 21/00065 |
| 2004/0162199 | A1 * | 8/2004 | Connelly | A63B 21/072 482/109 |
| 2013/0072359 | A1 * | 3/2013 | Leach | A63B 21/0728 482/107 |
| 2013/0172160 | A1 * | 7/2013 | Poole | A63B 23/0458 482/129 |
| 2014/0024504 | A1 * | 1/2014 | Potts | A63B 21/4035 482/106 |
| 2014/0162849 | A1 * | 6/2014 | Engle, Jr. | A63B 21/06 482/110 |
| 2015/0148201 | A1 * | 5/2015 | Schmidt | A63B 21/0728 482/107 |
| 2016/0144220 | A1 * | 5/2016 | Wood | A63B 21/0601 482/93 |
| 2020/0147439 | A1 * | 5/2020 | Acuna, Jr. | A63B 21/4035 |
| 2020/0188724 | A1 * | 6/2020 | Bauerle | A63B 21/4049 |
| 2020/0238127 | A1 * | 7/2020 | Wehrell | A63B 21/40 |
| 2020/0282255 | A1 * | 9/2020 | Aberton | A63B 21/0724 |
| 2022/0062683 | A1 * | 3/2022 | Zhang | A63B 21/0722 |

* cited by examiner

*Primary Examiner* — Andrew S Lo
(74) *Attorney, Agent, or Firm* — Tillman, Wright & Wolgin; James D. Wright; David R. Higgins

(57) ABSTRACT

A detachable strength training device, for football linemen and other athletes, includes a frame structure, a weight bar, and a removable weight assembly. The frame structure includes a peripheral frame and at least one crossbar providing a plurality of grip points.

20 Claims, 20 Drawing Sheets

DETACHABLE STRENGTH TRAINING DEVICE FOR LINEMEN AND OTHER ATHLETES

CROSS-REFERENCE TO RELATED APPLICATIONS

The present application is a non-provisional patent application of, and claims the benefit under 35 U.S.C § 119(e) to, U.S. Provisional Patent Application No. 63/130,627, filed Dec. 25, 2020 and entitled "ADJUSTABLE WEIGHT TRAINING DEVICE FOR FOOTBALL LINEMEN AND OTHER ATHLETES," the entirety of which is expressly incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to football training devices, and, in particular, to a detachable strength training device for football linemen and other athletes.

Background

For many athletes, strength training is an important part of the athlete's regimen. This is particular true for most or all American football players. Weight training and other types of strength training may be general in nature, for building strength throughout the body, or may be more specific, such as for building upper body strength. In addition, specific exercises utilizing strength training have been developed for use in targeting particular skills, techniques, and methods used by players who play different positions, or for players in different sports.

Football linemen and certain other players are generally among the strongest players at any position, but they are often called upon to use their upper body, arms, and hands to block defensive players or to fight off or through blocks by offensive players. Thus, it is useful for linemen and other players involved in the blocking portion of the game to engage in exercises and training that particularly target the muscles and techniques used therein. Historically, athletes simply used existing weights in different ways, often mimicking blocking and block-shedding techniques while doing so. More recently, one or more specialized weight and other strength training devices have been developed to aid in these exercises and training techniques. However, such specialized devices utilize fixed amount of weight and do not provide the ability for athletes to adjust the weights being used. Thus, a need exists for a training device for linemen and other athletes that provides allows the user to adjust the amount of weight being utilized while carrying out position-specific exercises.

SUMMARY OF THE PRESENT INVENTION

Some exemplary embodiments of the present invention may overcome one or more of the above disadvantages and other disadvantages not described above, but the present invention is not required to overcome any particular disadvantage described above, and some exemplary embodiments of the present invention may not overcome any of the disadvantages described above.

The present invention includes many aspects and features. Moreover, while many aspects and features relate to, and are described in, the context of strength training for football linemen, the present invention is not limited to use only in strength training for football linemen, as will become apparent from the following summaries and detailed descriptions of aspects, features, and one or more embodiments of the present invention.

Broadly defined, the present invention according to one aspect relates to a detachable strength training device for football linemen and other athletes, including a frame structure; a weight bar; and a removable weight assembly.

In a feature of this aspect, the frame structure includes a peripheral frame and at least one crossbar providing a plurality of grip points.

In another feature of this aspect, the detachable strength training device further includes a barbell support element. In further features, the barbell support element extends between two crossbars; the two crossbars and barbell support element are collectively "H"-shaped; the two crossbars and barbell support element are collectively "A"-shaped; the barbell support element includes a first coupling, the weight bar includes a second coupling, and the first and second couplings removably mate together such that the weight bar is removable from the frame structure; the first coupling is a threaded female coupling, and the second coupling is a threaded male coupling; and/or the first coupling includes a keyhole slot, and wherein the second coupling includes a knobbed prong that is removably received in the keyhole slot.

In another feature of this aspect, the removable weight assembly is removably carried on the weight bar. In further features, the removable weight assembly includes at least one weight and a weight retainer; the at least one weight includes a weight plate, having a center hole, and wherein the weight plate is carried on the weight bar via the center hole; the at least one weight includes at least two weight plates; the weight retainer includes a spring clip; and/or the weight retainer includes a ring pin with a detent.

In another feature of this aspect, the peripheral frame is octagonal.

In another feature of this aspect, the peripheral frame is circular.

In another feature of this aspect, the peripheral frame and at least one crossbar are made of tubular metal.

In another feature of this aspect, the frame structure further includes one or more resistance band retention structures. In a further feature, the detachable strength training device further includes a pair of resistance bands removably attached to the one or more resistance band retention structures.

Further areas of applicability of the present invention will become apparent from the detailed description provided hereinafter. It should be understood that the detailed description and specific examples, while indicating preferred embodiment(s) of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
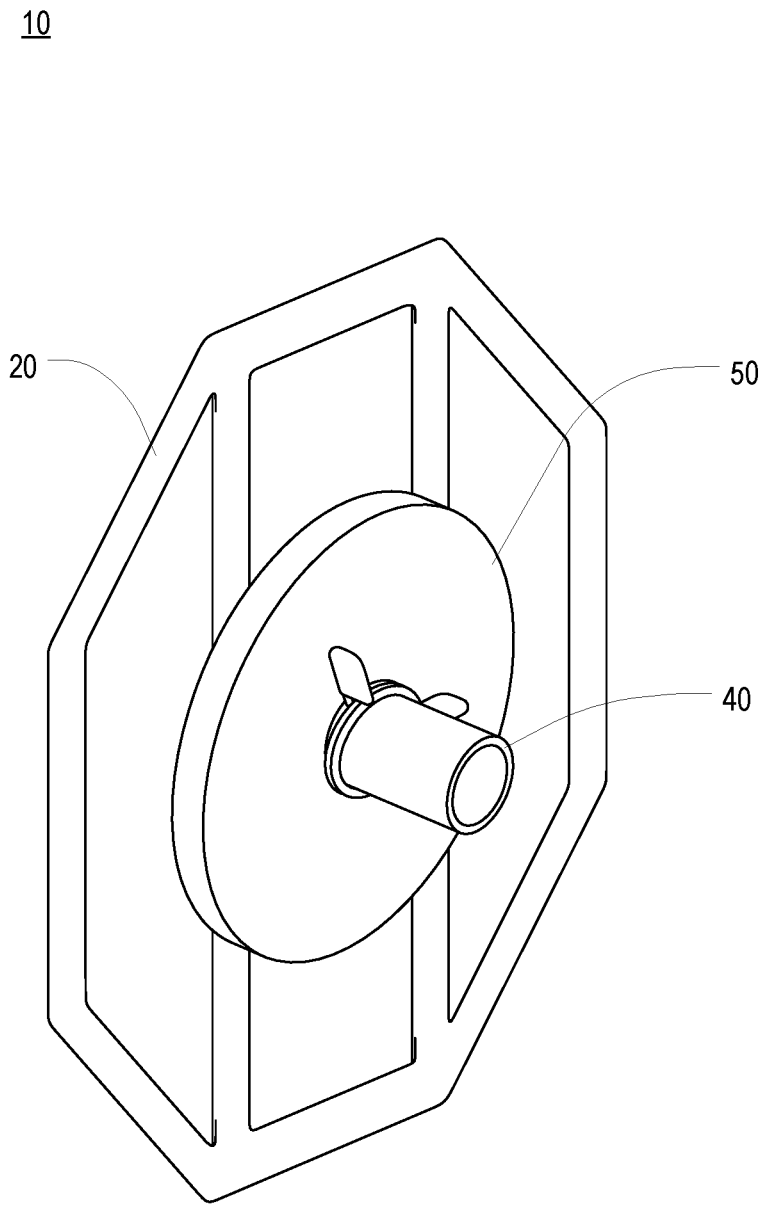
FIG. 1 is a perspective view of a detachable strength training device for football linemen and other athletes in accordance with one or more preferred embodiments of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Furthermore, an embodiment of the invention may incorporate only one or a plurality of the aspects of the invention disclosed herein; only one or a plurality of the features disclosed herein; or combination thereof. Moreover, many embodiments, including adaptations, variations, modifications, and equivalent arrangements, are implicitly disclosed herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

With regard solely to construction of any claim with respect to the United States, no claim element is to be interpreted under 35 U.S.C. 112(f) unless the explicit phrase "means for" or "step for" is actually used in such claim element, whereupon this statutory provision is intended to and should apply in the interpretation of such claim element. With regard to any method claim including a condition precedent step, such method requires the condition precedent to be met and the step to be performed at least once during performance of the claimed method.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Further, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

Figure 2:
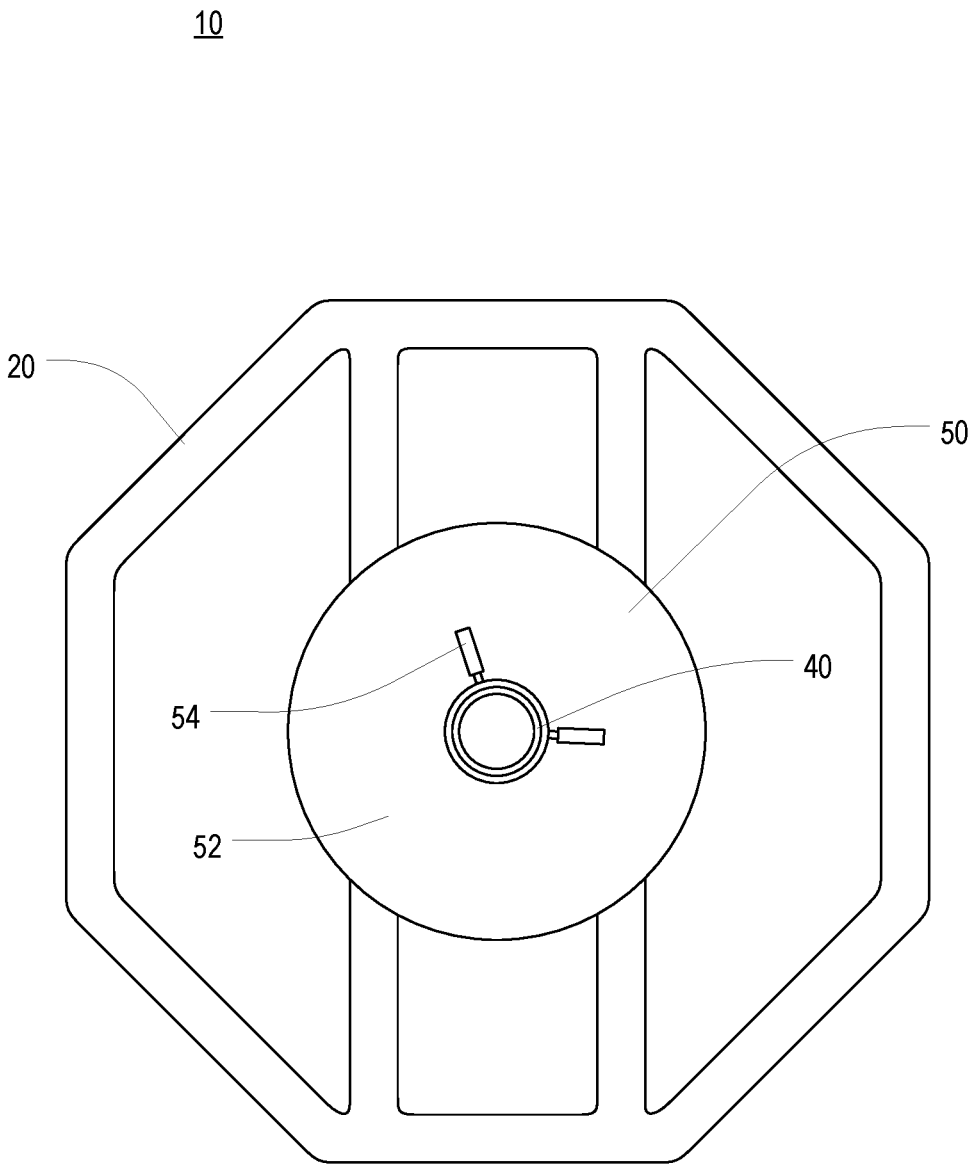
FIG. 2 is a front view of the detachable strength training device of FIG. 1.
Figure 3:
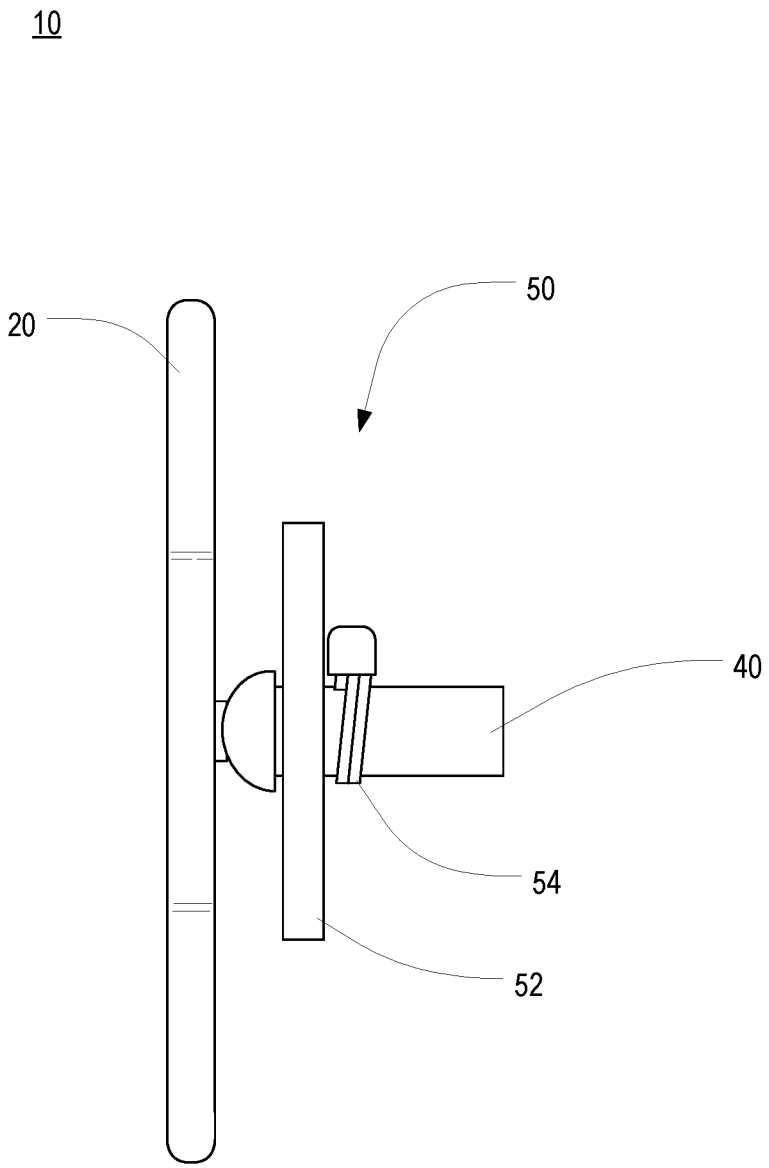
FIG. 3 is a left side view of the detachable strength training device of FIG. 1.

FIGS. 1, 2, and 3 are a perspective view, a front view, and a left side view of a detachable strength training device 10 for football linemen and other athletes in accordance with one or more preferred embodiments of the present invention. As shown therein, the device 10 includes a frame structure 20, a weight bar 40, and a removable weight assembly 50. Each of these will be described in further detail hereinbelow.

Figure 4:
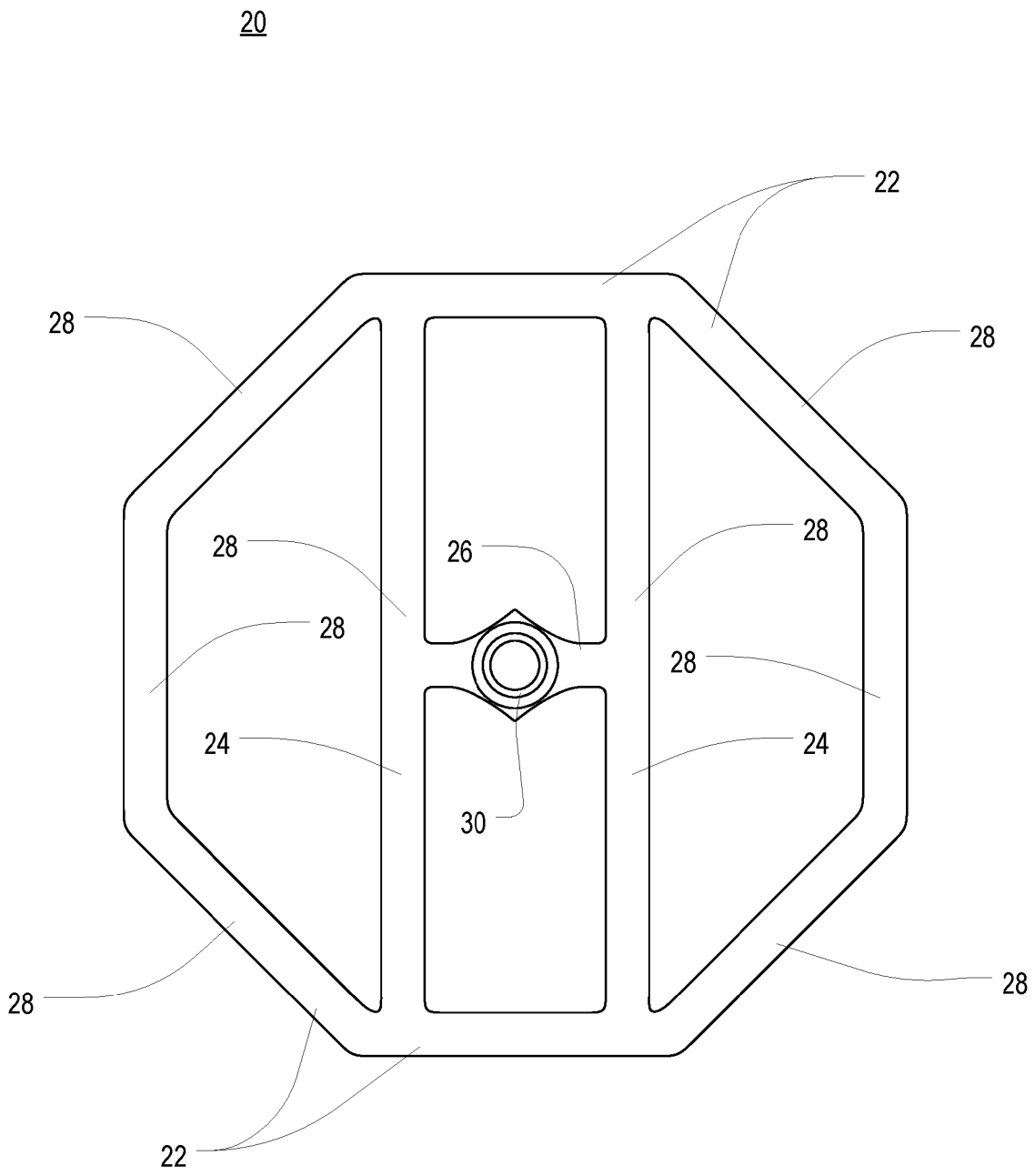
FIG. 4 is a front view of frame structure of FIG. 1.

FIG. 4 is a front view of frame structure 20 of FIG. 1. The frame structure 20 includes a peripheral frame 22, a pair of crosspieces 24, and a barbell support element 26. The peripheral frame 22 supports the other elements as well as providing various grip points 28 for use by a user 100 in holding the device 10. The crosspieces 24 are structural members that are supported by the peripheral frame 22 and in turn provide support for the barbell support element 26 as well as providing additional grip points 28. The barbell support element 26 provides an attachment point and interface for the weight bar 40. In the illustrated embodiment, the peripheral frame 22, the crosspieces 24, and the barbell support element 26 are all constructed from similar materials, which may, for example, be segments of 1-inch diameter metal pipe that are welded together. However, in alternative embodiments, different materials and construction methods may be used, and/or the materials and construction of the crosspieces 24 and the barbell support element 26 may vary from the peripheral frame 20 and/or from each other. In at least some embodiments, the barbell support element 26 includes a coupling 30 that mates with and supports the weight bar 40 as further described hereinbelow. In the illustrated embodiment, the coupling 30 is a threaded female coupling. It will be appreciated, however, that other types of couplings may be substituted without departing from the present invention.

Figure 5:
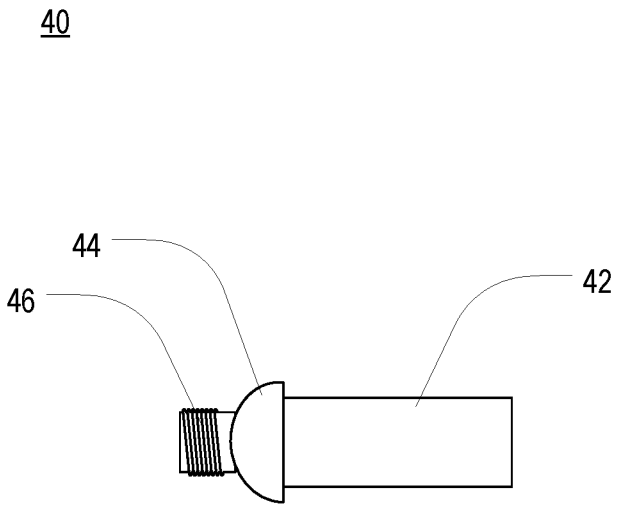
FIG. 5 is a left side view of the weight bar of FIG. 1.
Figure 6:
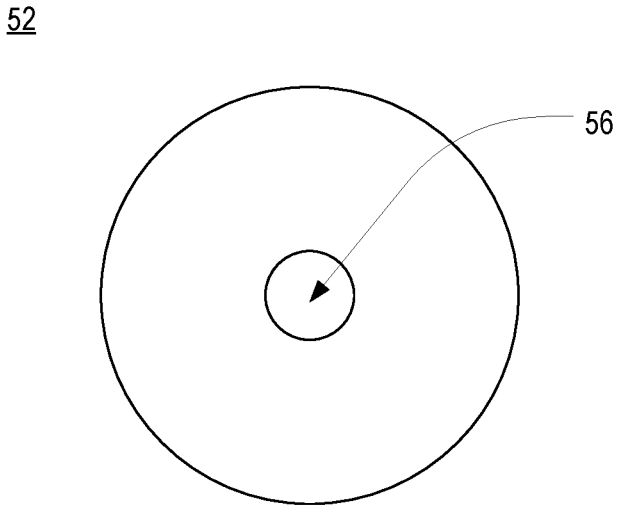
FIG. 6 is a front view of the weight plate of FIG. 1.

FIG. 5 is a left side view of the weight bar 40 of FIG. 3. The weight bar 40 is adapted to receive the weight assembly 50, which includes one or more weight 52 and a weight retainer 54, such as a spring clip. The weights 52 are preferably (but not necessarily) of conventional construction, such as conventional weight plates having center openings 56. An example of such a weight plate is shown in FIG. 6. However, custom, non-conventional weights may alternatively be utilized. As shown in FIG. 5, the weight bar 40 preferably includes a dumbbell section 42, a head 44, and a coupling 46. In various embodiments, including the illustrated embodiment, the dumbbell section 42 is a cylindrical body of solid or tubular cross-section that is long enough to receive at least one, and preferably at least two, conventional weight plates 52 having central openings 56 of a conventional size. The head 44 serves as a backstop for weight plates 52 received on the dumbbell section 42. In the illustrated embodiment, a forward portion of the head 44 has a circular cross-section that is wider than the conventional weight plate center opening 56 by an amount that is sufficient to prevent the weight plate 52 from sliding farther down the weight bar 40. The head 44 thus serves to space the weight plates 52 from the crosspieces 24 and other elements of the frame structure 20, thereby allowing a user 100 to grip the frame structure 20. The head 44 also provides a base for the coupling 46, which in the illustrated embodiment is a threaded male coupling that mates with the threaded female coupling 30. It will be appreciated, however, that other types of couplings may be substituted without departing from the scope of the present invention.

Figure 7:
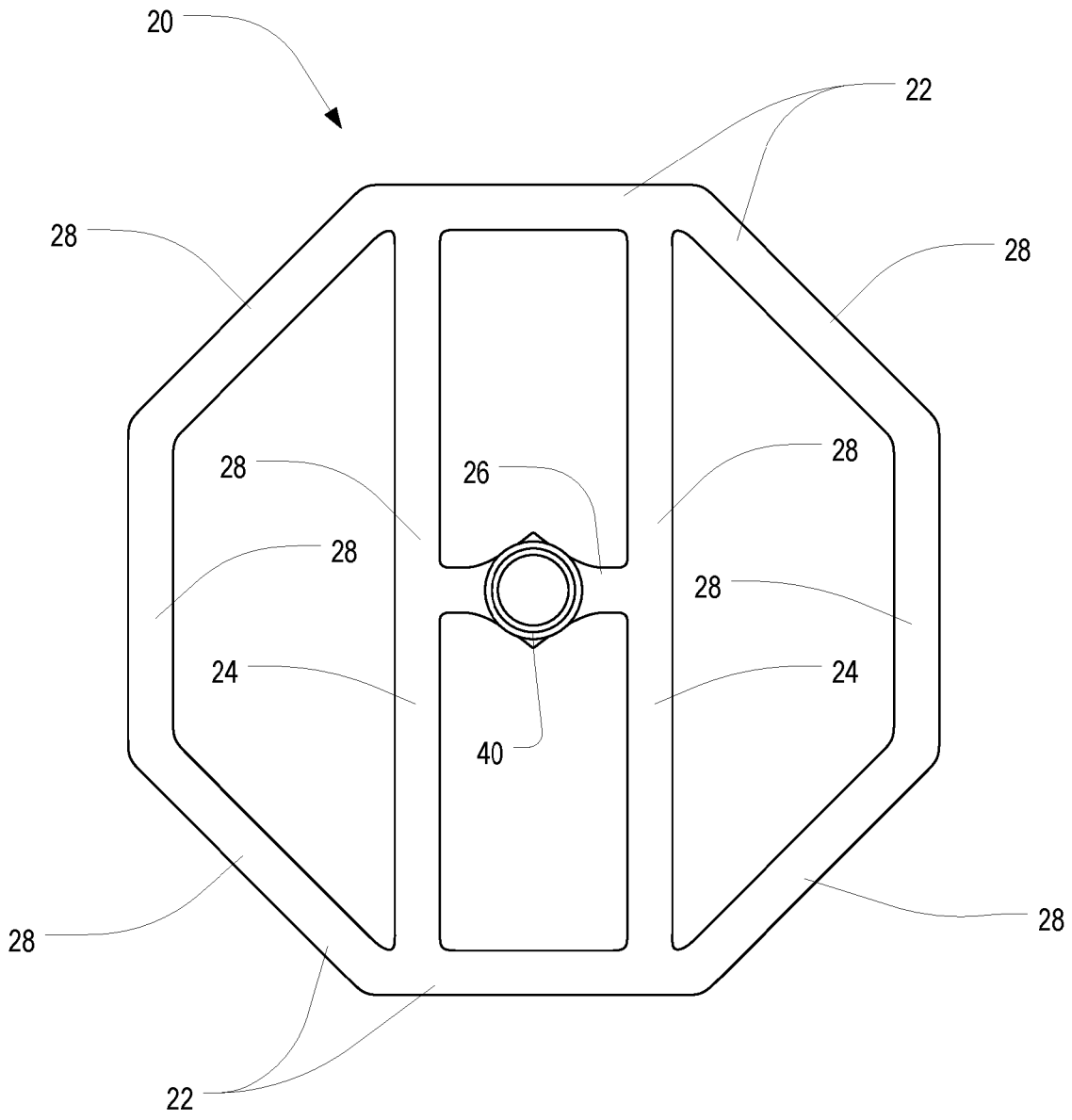
FIG. 7 is a front view of the frame structure of FIG. 4, shown with the weight bar coupled thereto.

In at least some embodiments, the weight bar 40 of FIG. 5 may be readily installed and removed from the frame structure 20 of FIG. 4. In this regard, FIG. 7 is a front view of the frame structure 20 of FIG. 4, shown with the weight bar 40 coupled thereto. With respect to the illustrated couplings 30,46, the male coupling 46 may be screwed into the female coupling 30 a sufficient amount to retain it securely thereon. Once the weight bar 40 is securely mounted on the frame structure 20, one or more weight plates 52 may be mounted on the weight bar 40, as shown in FIG. 1.

Figure 8:
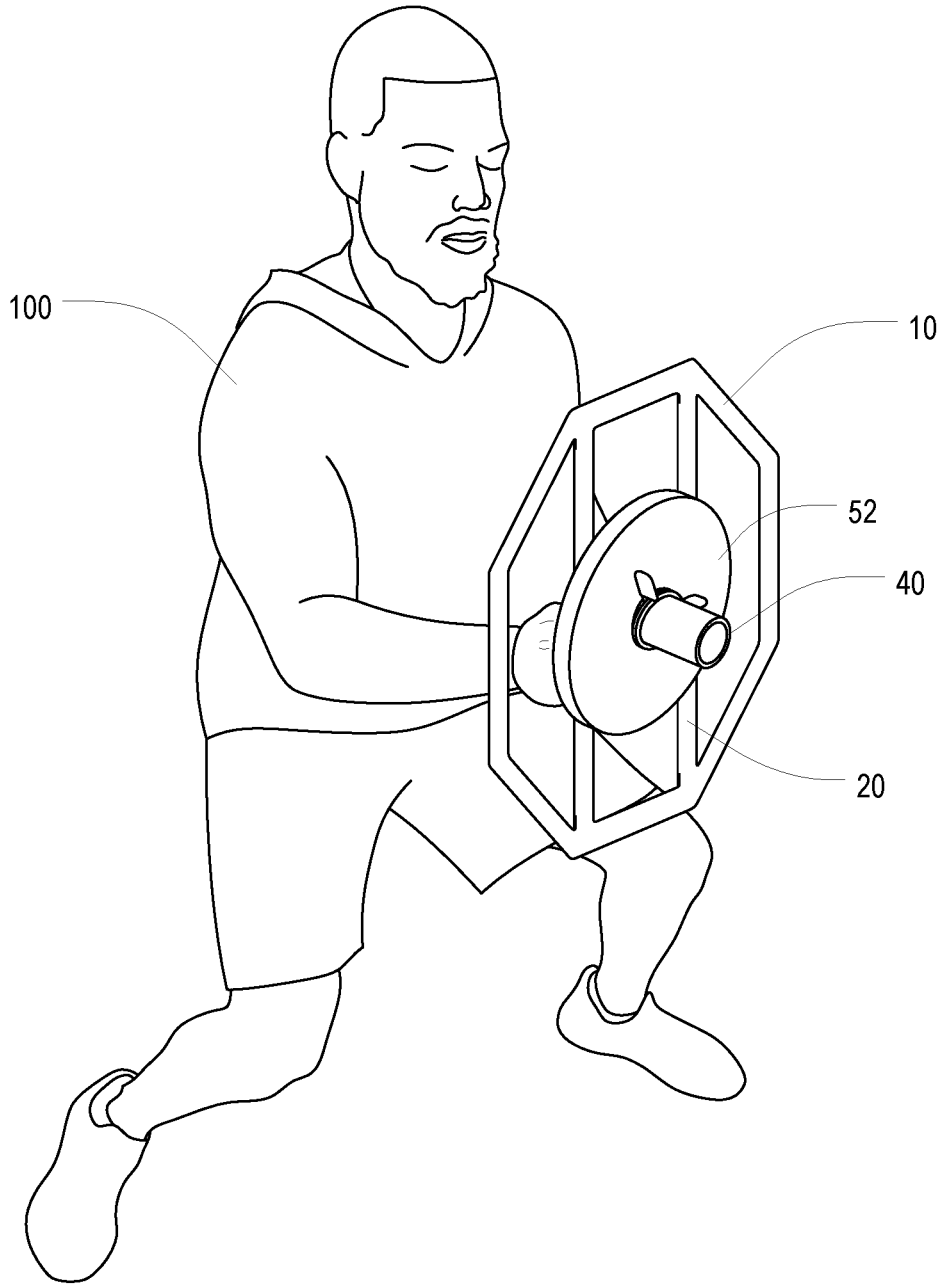
FIG. 8 is a perspective view of an athlete using the football training device of FIG. 2.

Although the weight training device 10 may be used for weight and strength training in a variety of ways, it is particularly well-suited for use by football players and other similar athletes 100 in enhancing certain skill training through the use of weight. In this regard, FIG. 8 is a perspective view of an athlete using the football training device of FIG. 2. In at least some methods of use, the user 100 grips the frame structure 20 at desired locations and holds the device 10 in front him. The particular grip points 28 that are used may be selected to mimic certain movements made while playing football or some other sport such that the athlete 100 practices the movement while simultaneously supporting the weight of the frame structure 20 and weight assembly 50. In the exemplary method of use illustrated in FIG. 8, the user 100 is practicing hand positions used by a football lineman.

Figure 9A:
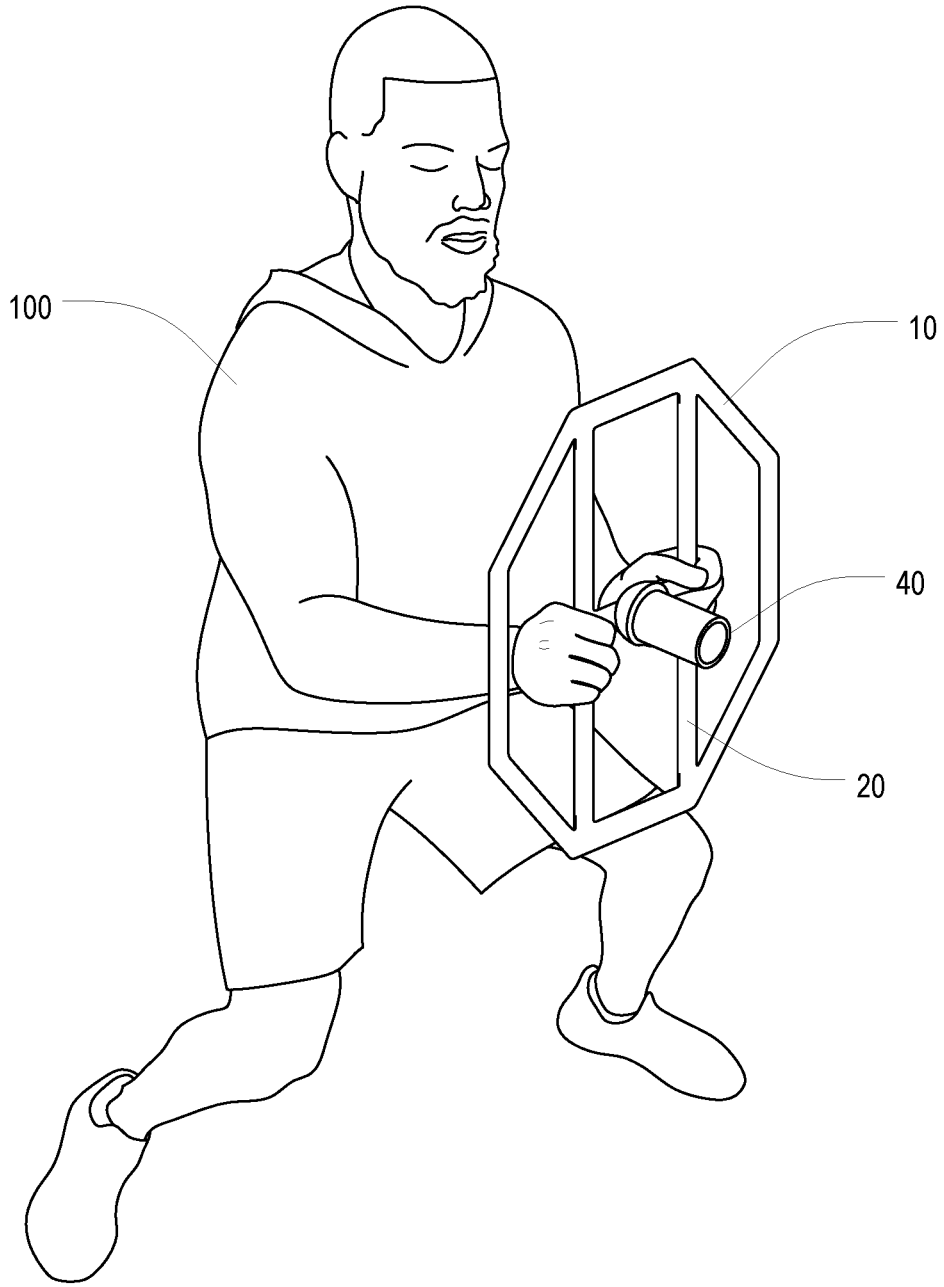
FIG. 9A is a perspective view of an athlete using the football training device of FIG. 2 with the weight removed.
Figure 9B:
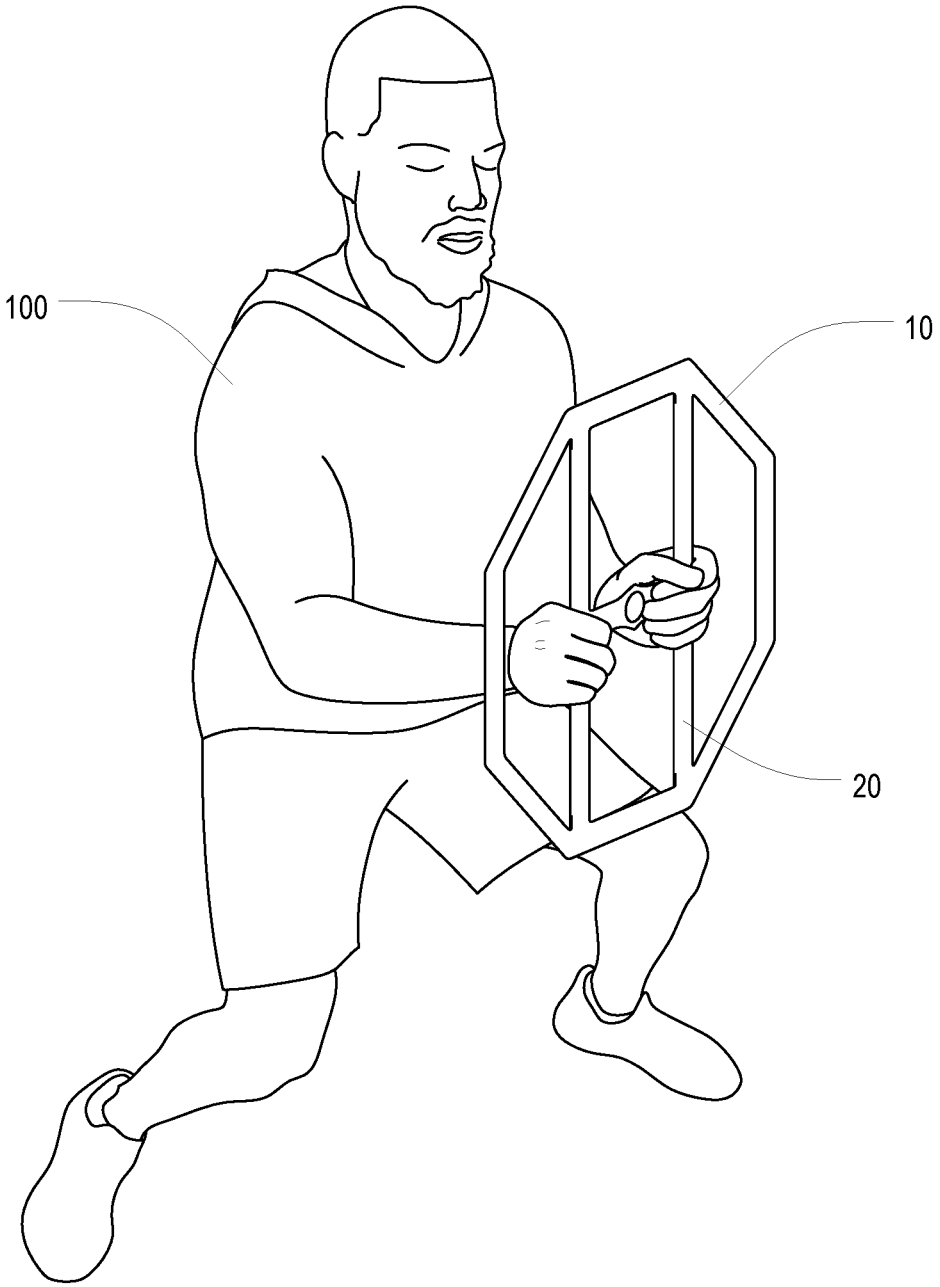
FIG. 9B is a perspective view of an athlete using the football training device of FIG. 4.

Notably, the amount of weight that is used may be varied. For example, the weight 52 may be removed such that the user 100 works with only the weight of the frame structure 20 and the weight of the weight bar 40. In this regard, FIG. 9A is a perspective view of an athlete using the football training device of FIG. 2 with the weight 52 removed. In another example, both the weight 52 and the weight bar 40 may be removed such that the user 100 works with only the weight of the frame structure 20 itself. In this regard, FIG. 9B is a perspective view of an athlete using the football training device of FIG. 4. In other examples, a larger or smaller weight plate 52 may be substituted for the one shown in FIG. 8, or one or more additional weight 52 may be added to the weight bar 40, or a weight bar 40 of a different weight may be utilized, or the weight may otherwise be varied.

Figure 10:
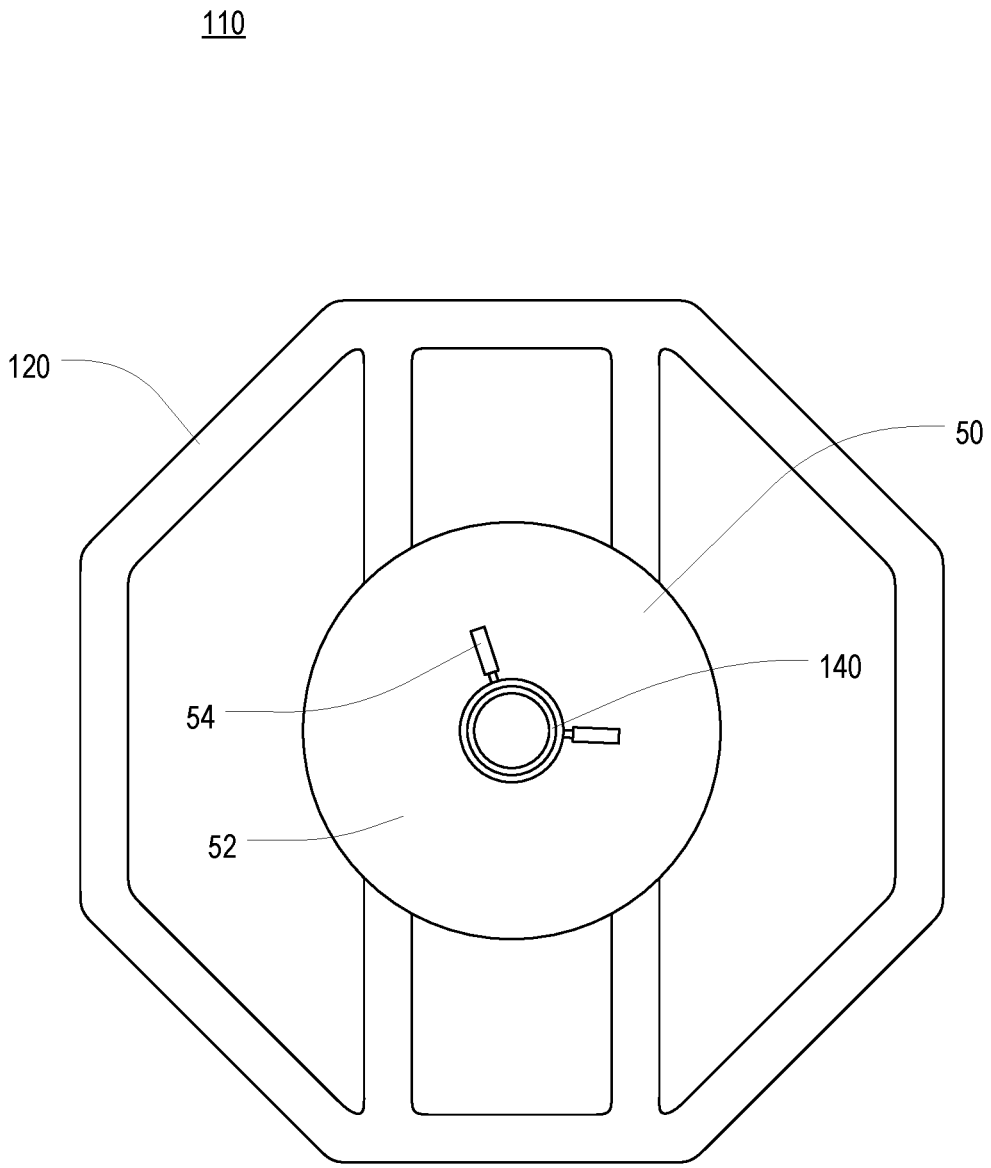
FIG. 10 is a front view of another detachable strength training device for football linemen and other athletes in accordance with one or more preferred embodiments of the present invention.
Figure 11:
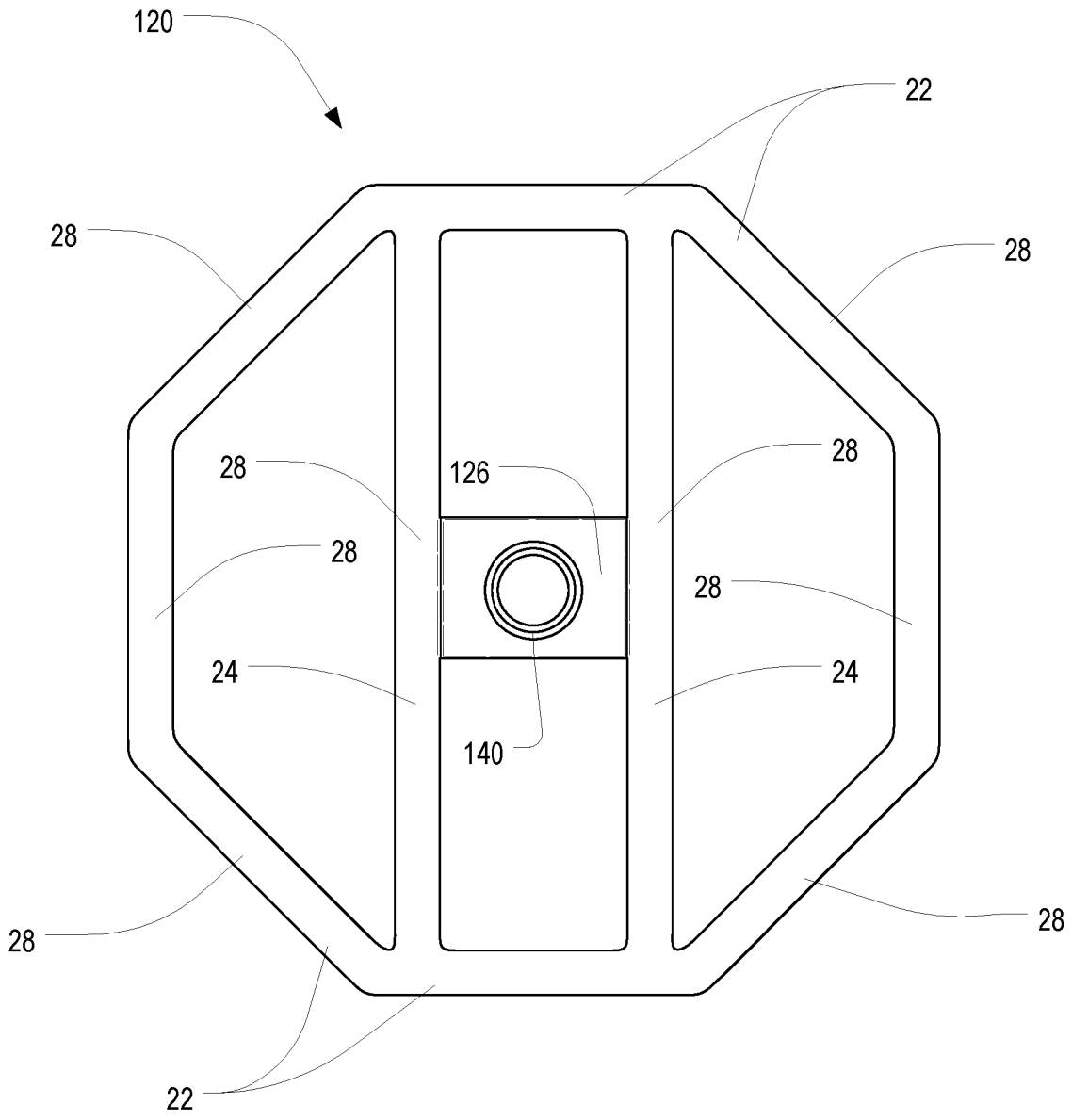
FIG. 11 is a front view of the detachable strength training device of FIG. 10, shown with the weight plate and spring clip removed.
Figure 12:
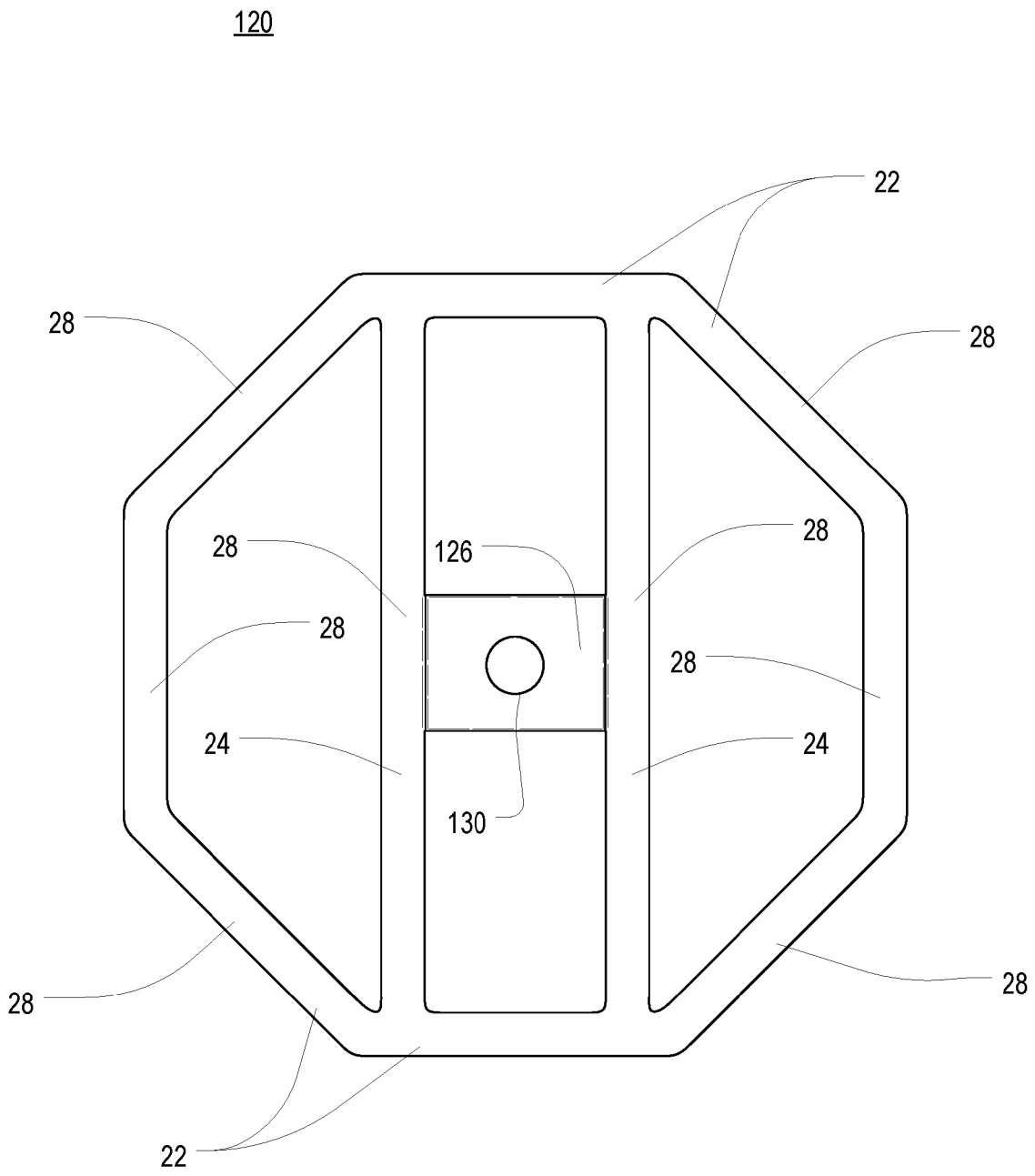
FIG. 12 is a front view of the detachable strength training device of FIG. 11, shown with the weight bar removed.

Various elements of the device may be embodied in different ways. For example, FIG. 10 is a front view of another detachable strength training device 110 for football linemen and other athletes in accordance with one or more preferred embodiments of the present invention, and FIG. 11 is a front view of the detachable strength training device 110 of FIG. 10, shown with the weight plate 52 and spring clip 54 removed, and FIG. 12 is a front view of the detachable strength training device 110 of FIG. 11, shown with the weight bar 140 removed. The device 110 is similar in many respects to the device of FIG. 1, but the barbell support element 126 is somewhat larger and is formed from a large flat piece of metal.

Figure 13:
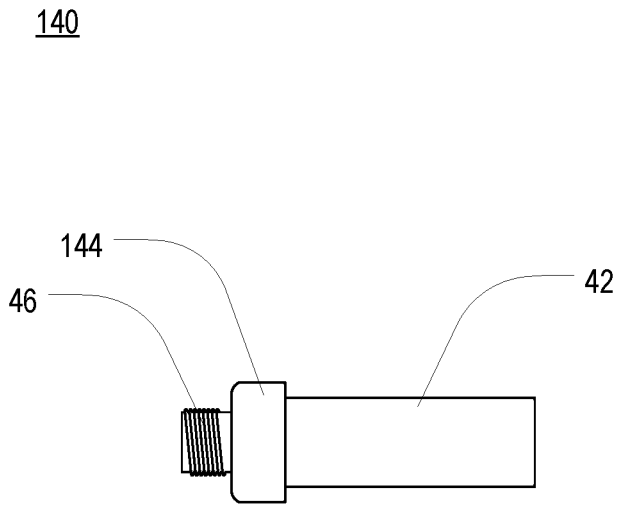
FIG. 13 is a left side view of the weight bar of FIG. 11.
Figure 14:
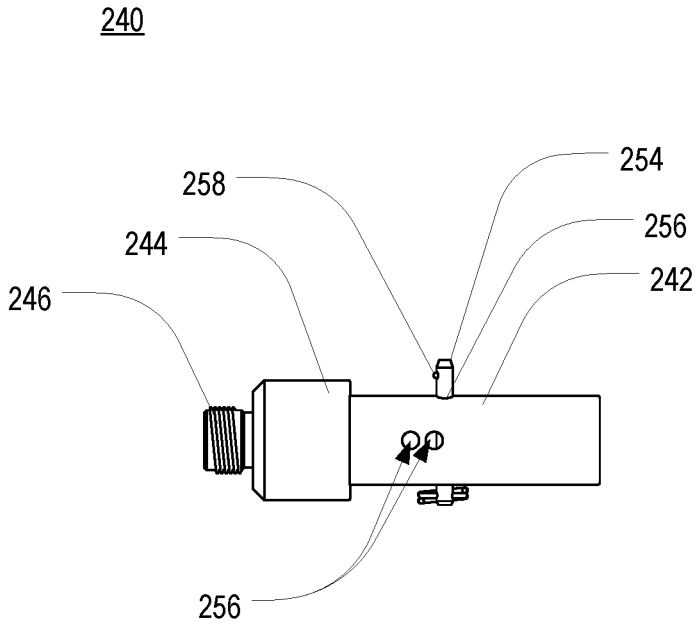
FIG. 14 is a left side view of an alternative weight bar for use with the frame structure of FIG. 4 or FIG. 12.

FIG. 13 is a left side view of the weight bar 140 of FIG. 11. A logo or other image or text may be placed on the side of the weight bar 140 if desired. The weight bar 140 preferably includes a dumbbell section 42, a head 144, and a coupling 46. The head 144 is different in shape from the head 44 of the weight bar 40 of FIG. 1, but overall the weight bar 140 functions similarly to that of FIG. 1. The size of the head may be varied if desired, particularly if greater space is desired for the user's hands between the weight 52 and the barbell support element 26,126 and other portions of the frame structure 20,120. A longer head 244 is shown in FIG. 14, which is a left side view of an alternative weight bar 240 for use with the frame structure 20,120 of FIG. 4 or FIG. 12. This weight bar 240 also includes a coupling 46 that is somewhat shorter than that of the weight bar 140 of FIG. 13, and may be used with a corresponding female coupling that is not as deep, thereby reducing the required thickness of the barbell support element. The dumbbell section 242 is otherwise similar to that of the weight bar 140 of FIG. 13 but includes several pairs of apertures 256 aligned on opposite sides thereof for receiving a ring pin 254 with a detent 258. The ring pin 254 serves as the weight retainer, and may be used with weight plates 52 of different thicknesses, or to accommodate different numbers of weight plates 52, and the number of aperture pairs 256 and their locations may be chosen accordingly. To use the ring pin, a user 100 places the desired weight or weights 52 and dumbbell section and then inserts the ring pin 254 through a selected pair of apertures 256 with enough force to overcome the biasing force of the detent spring. Once fully inserted through both apertures 256 of the pair, the detent 258 holds the ring pin 254 in place, thereby holding the weights 52 on the dumbbell section 242.

Notably, in some embodiments (not illustrated), a weight assembly and a weight bar are integrated into a single unit that may be removably coupled to the frame structure 20,120. In at least some of these embodiments, an integrated weight assembly and weight bar unit may be provided in different weights, and an integrated unit of one weight may be removed and replaced with an integrated unit of a different weight.

Figure 15:
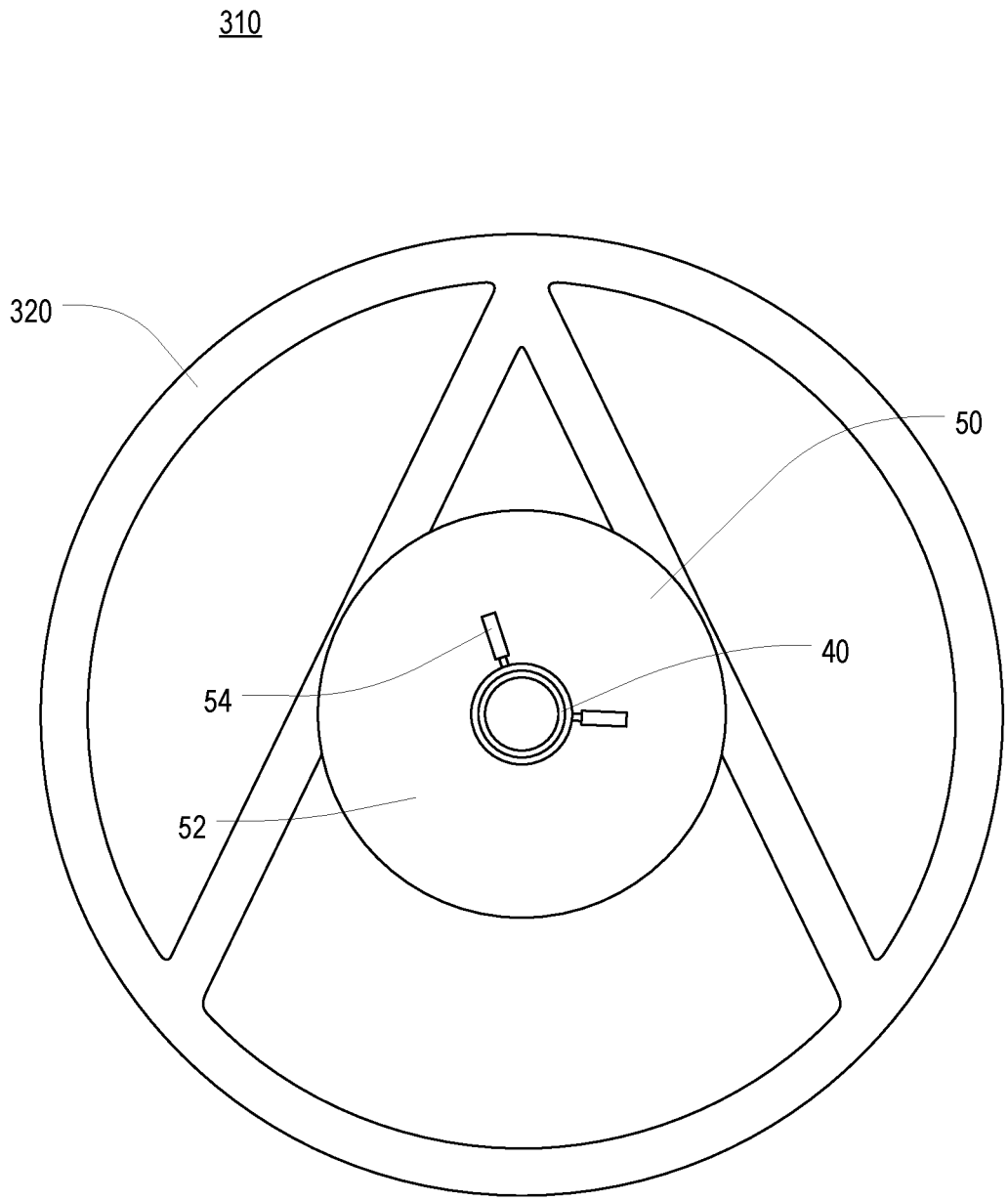
FIG. 15 is a front view of another detachable strength training device for football linemen and other athletes in accordance with one or more preferred embodiments of the present invention.
Figure 16:
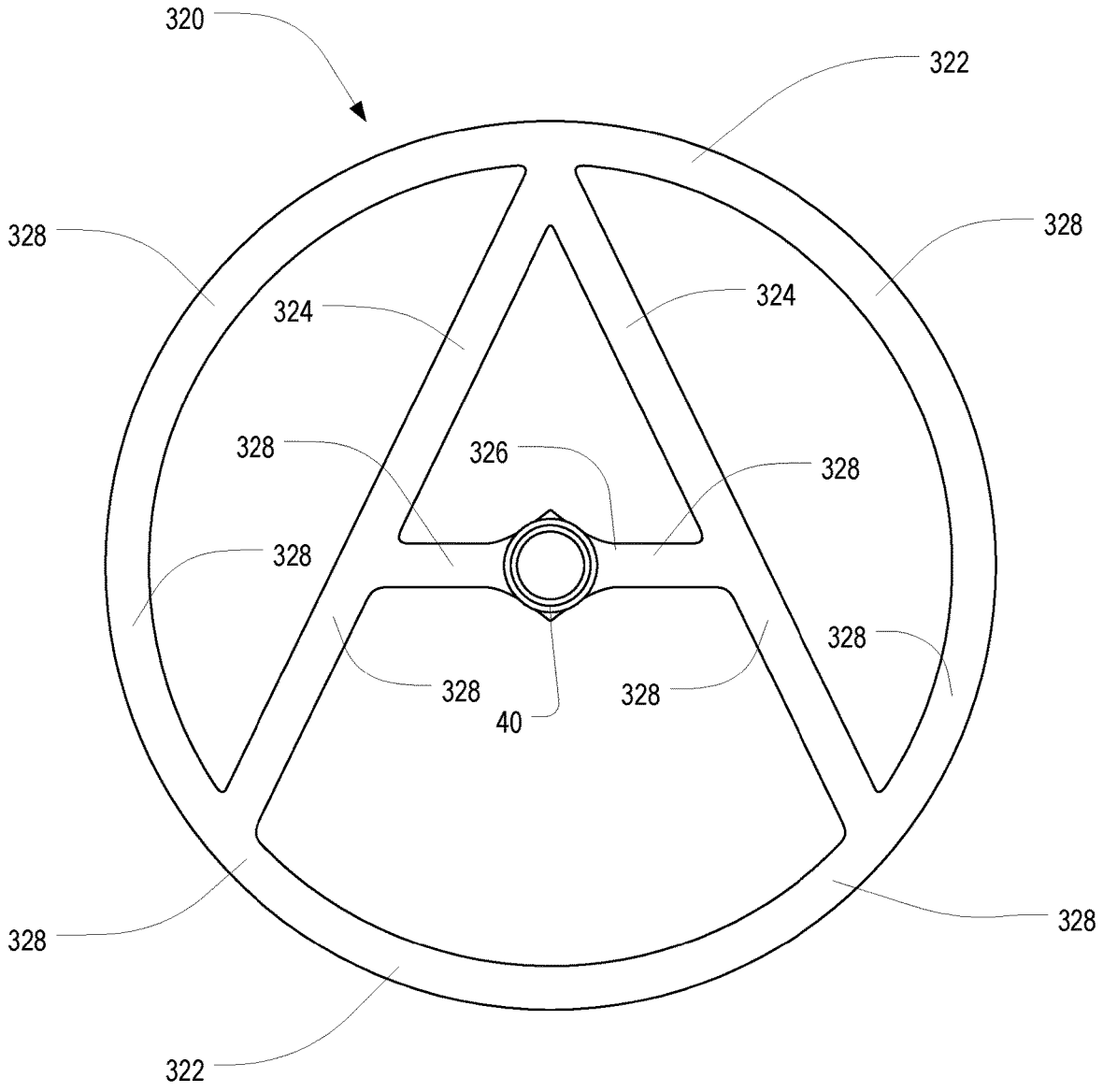
FIG. 16 is a front view of the detachable strength training device of FIG. 15, shown with the weight plate and spring clip removed.

The frame structure may be shaped differently as well. In this regard, FIG. 15 is a front view of another detachable strength training device 310 for football linemen and other athletes in accordance with one or more preferred embodiments of the present invention, and FIG. 16 is a front view of the detachable strength training device 310 of FIG. 15, shown with the weight plate 52 and spring clip 54 removed. As shown therein, the device 310 includes a frame structure 320, a weight bar 40, and a removable weight assembly 50. The weight bar 40 and removable weight assembly 50 are similar to those of FIG. 1, although as described previously, different weight bars 140,240 and removable weight assemblies may be substituted therefor.

Figure 17:
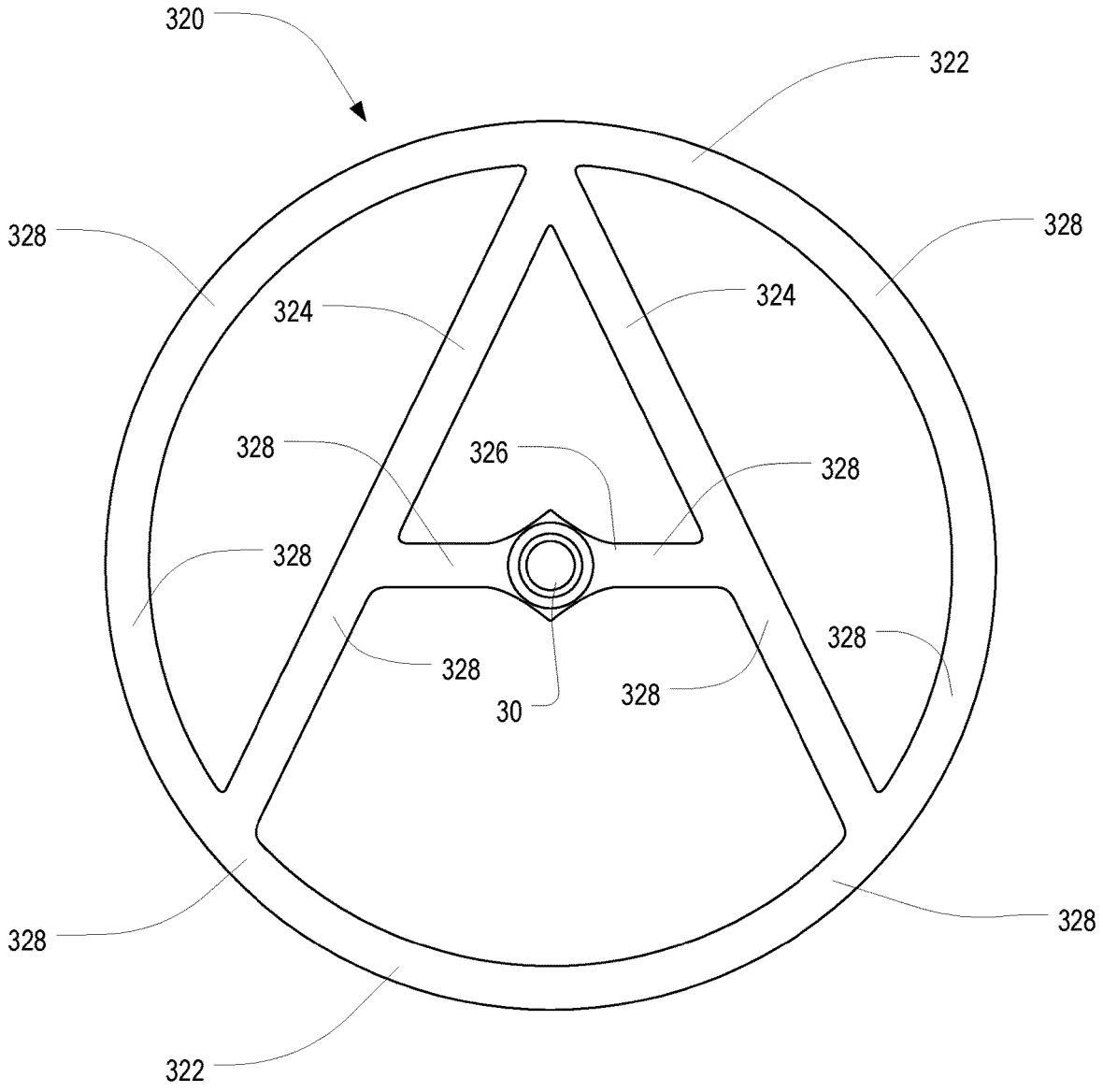
FIG. 17 is a front view of the detachable strength training device of FIG. 16, shown with the weight bar removed.

FIG. 17 is a front view of the detachable strength training device 310 of FIG. 16, shown with the weight bar 40 removed. The frame structure 320 includes a peripheral frame 322, a pair of crosspieces 324, and a barbell support element 326. The peripheral frame 322 supports the other elements as well as providing various grip points 328 for use by a user 100 in holding the device 310. The crosspieces 324 are structural members that are supported by the peripheral frame 322 and in turn provide support for the barbell support element 326 as well as providing additional grip points 328. The barbell support element 326 provides an attachment point and interface for the weight bar 40. The frame structure 320 is similar in many ways to the frame structure 20 of FIG. 4, but the peripheral frame 322 is generally circular instead of octagonal and the crosspieces 324 and barbell support element 326 are collectively "A"-shaped instead of "H"-shaped.

In the embodiment illustrated in FIGS. 15-17, the peripheral frame 322, the crosspieces 324, and the barbell support element 326 are all constructed from similar materials, which may, for example, be segments of 1-inch diameter metal pipe that are welded together. However, in alternative embodiments, different materials and construction methods may be used, and/or the materials and construction of the crosspieces 324 and the barbell support element 326 may vary from the peripheral frame 320 and/or from each other. In at least some embodiments, the barbell support element 326 includes a coupling 330 that mates with, and supports, the weight bar 40 as further described hereinbelow. In the illustrated embodiment, the coupling 330 is a threaded female coupling. It will be appreciated, however, that other types of couplings may be substituted without departing from the present invention.

Figure 18:
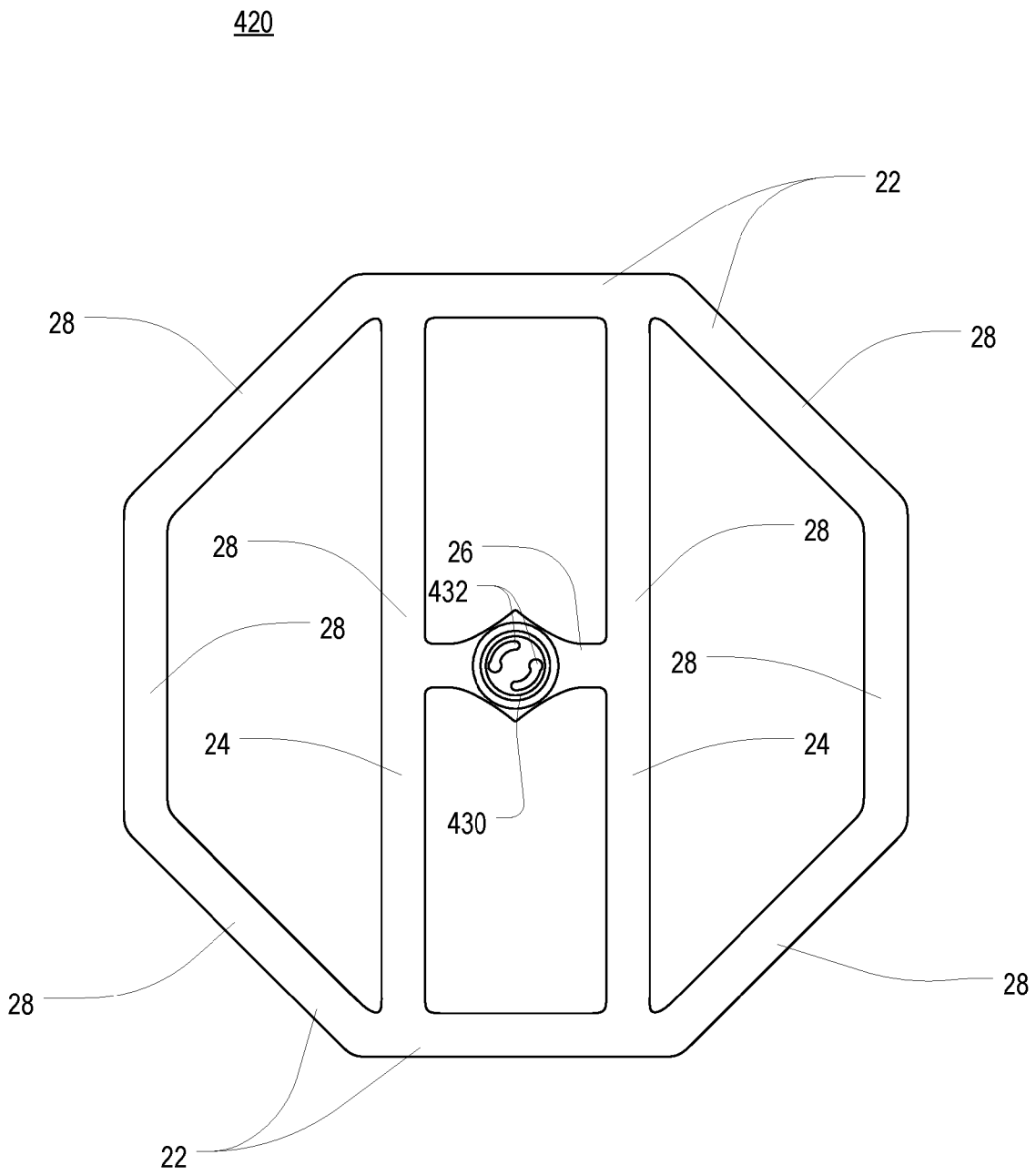
FIG. 18 is a front view of a frame structure for another detachable strength training device for football linemen and other athletes in accordance with one or more preferred embodiments of the present invention.
Figure 19:
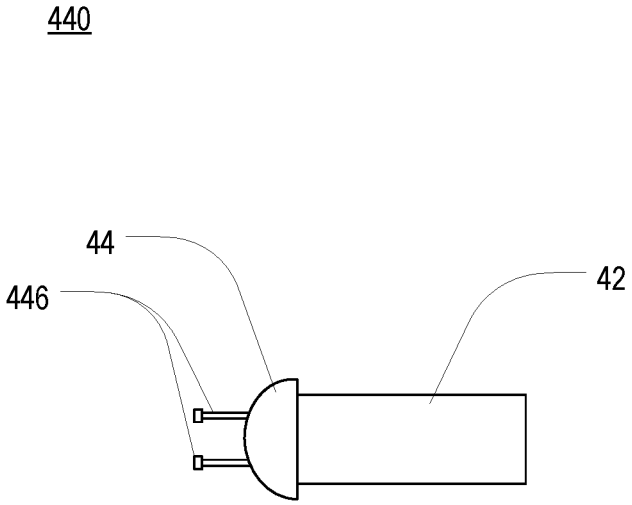
FIG. 19 is a left side view of a weight bar for use with the frame structure of FIG. 18.

FIG. 18 is a front view of a frame structure 420 for another detachable strength training device for football linemen and other athletes in accordance with one or more preferred embodiments of the present invention, and FIG. 19 is a left side view of a weight bar 440 for use with the frame structure 420 of FIG. 18. The frame structure 420 and weight bar 440 are generally similar to those of the device 10 of FIGS. 1-5, but use different couplings 430,446. More particularly, the coupling 446 of the weight bar 440 includes two male prongs with knobbed ends, and the coupling 430 on the frame structure 420 includes two corresponding female receptacles in the form of curved keyhole slots 432. The weight bar 440 may be attached to the frame structure 420 by inserting the male prongs 446 into the wide ends of the keyhole slots 432 and twisting the weight bar 440 clockwise to seat the prongs 446 at the opposite ends of the slots 432.

Figure 20:
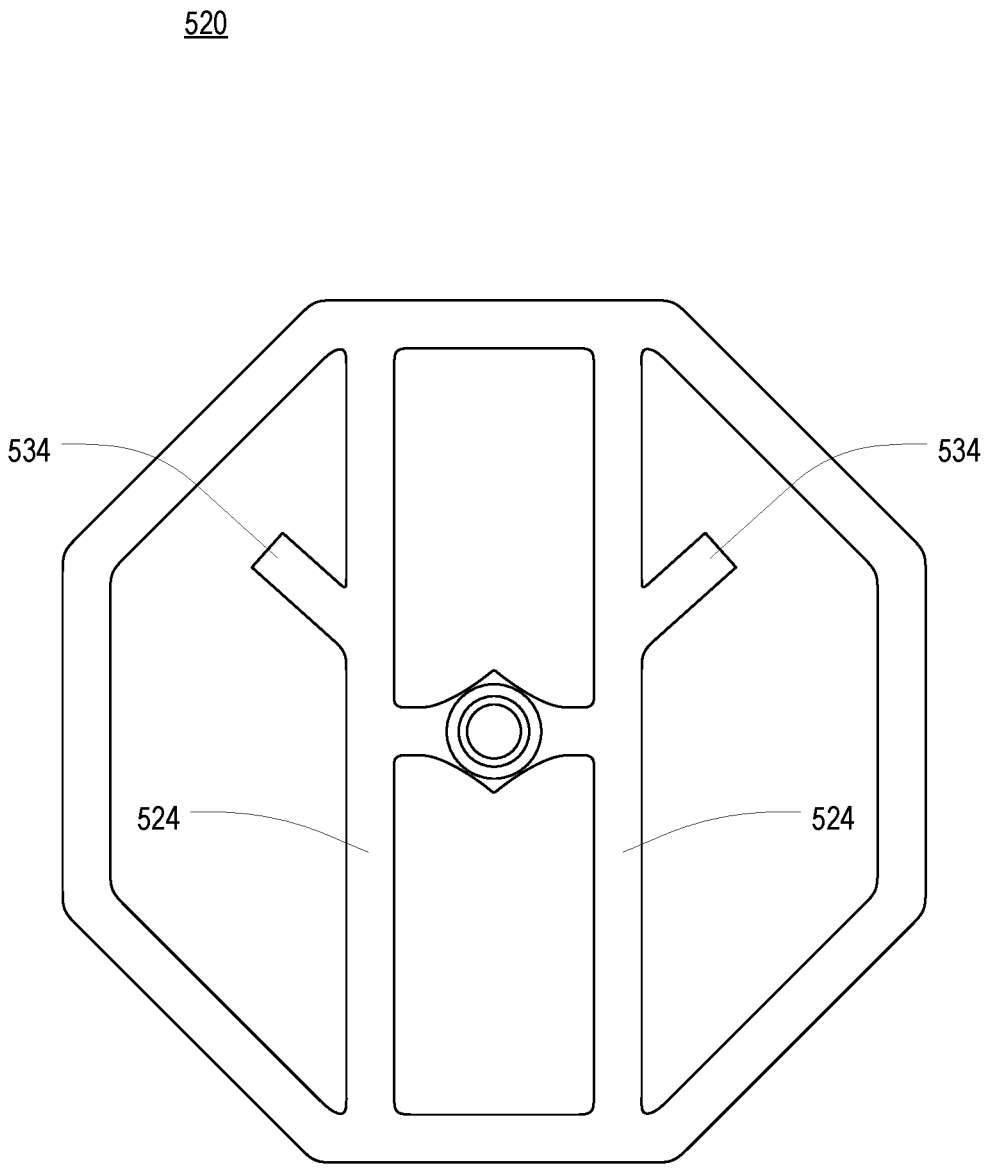
FIG. 20 is a front view of a frame structure for another detachable strength training device for football linemen and other athletes in accordance with one or more preferred embodiments of the present invention.
Figure 21:
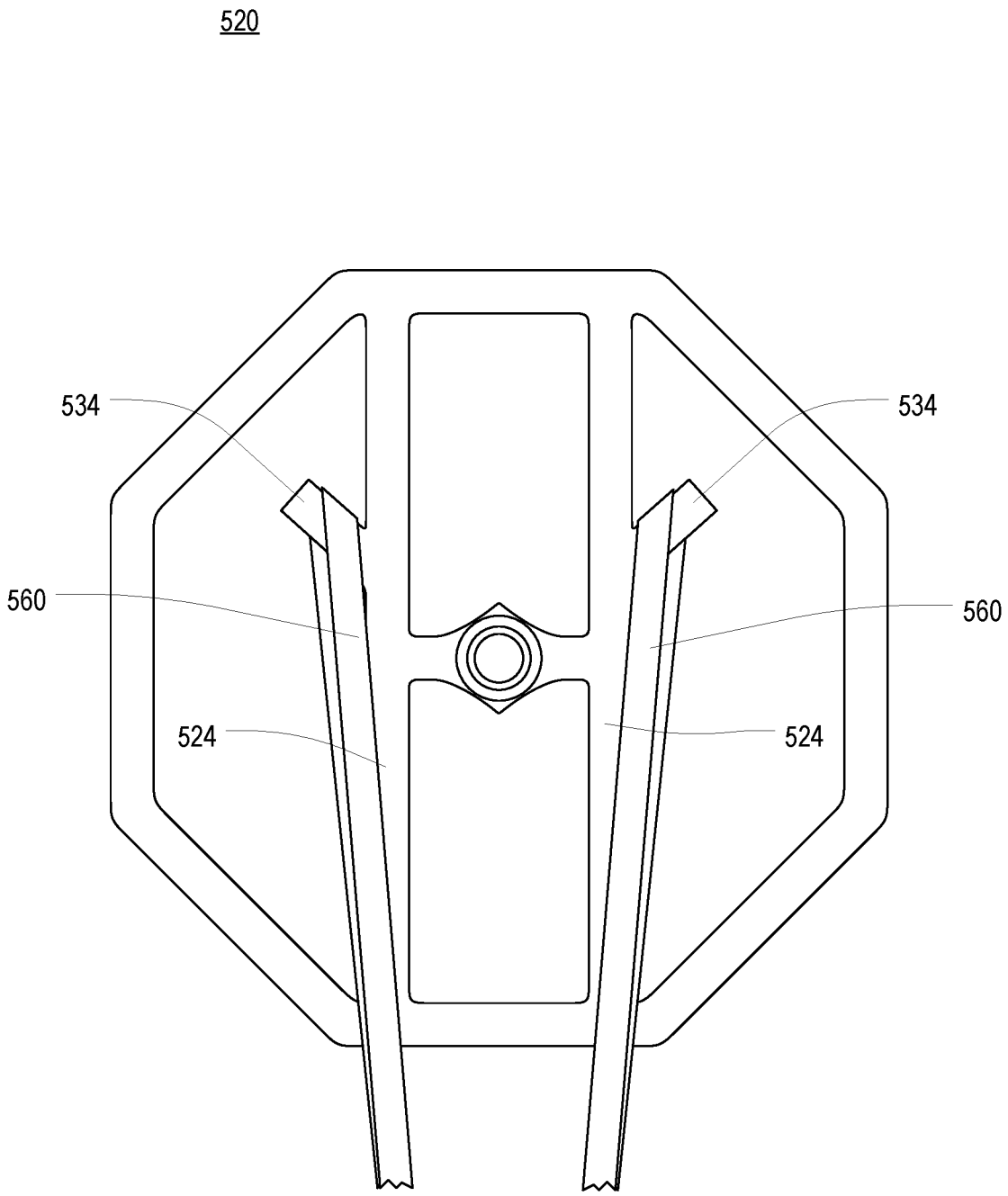
FIG. 21 is a fragmentary front view of the detachable strength training device of FIG. 20, shown with a pair of resistance bands attached thereto.

The frame structure may be modified in other ways to provide additional functionality. For example, FIG. 20 is a front view of a frame structure 520 for another detachable strength training device for football linemen and other athletes in accordance with one or more preferred embodiments of the present invention. The frame structure 520 is similar to the frame structure 10 of FIG. 1 except that the crosspieces 524 have been modified to include a pair of stubs 534 to receive and retain one or more resistance bands 560, as shown in FIG. 21. The resistance bands 560 provide an additional training element and may be used with or without a weight bar and/or removable weight assembly in place.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention is limited only by the claim(s) appended hereto and the equivalents thereof.

What is claimed is:

1. A detachable strength training device, comprising:

(a) a frame structure including:

(i) at least a top segment, a bottom segment, a left side segment, and a right sight segment, collectively forming a peripheral frame that defines a central opening, (ii) a plurality of crossbars extending from one segment of the frame structure across the central opening to another segment of the frame structure, and (iii) a barbell support element supported by at least two of the plurality of crossbars, wherein the barbell support element extends from one of the at least two crossbars to another, (iv) wherein the peripheral frame and the plurality of crossbars are co-planar with one another, and (v) wherein a plurality of grip points are provided on the peripheral frame and on the plurality of crossbars;

(c) a weight bar; and (d) a removable weight assembly.

2. The detachable strength training device of claim 1, wherein the two crossbars and barbell support element are collectively "H"-shaped.

3. The detachable strength training device of claim 1, wherein the two crossbars and barbell support element are collectively "A"-shaped.

4. The detachable strength training device of claim 1, wherein the barbell support element includes a first coupling, wherein the weight bar includes a second coupling, and wherein the first and second couplings removably mate together such that the weight bar is removable from the frame structure.

5. The detachable strength training device of claim 4, wherein the first coupling includes a keyhole slot, and wherein the second coupling includes a knobbed prong that is removably received in the keyhole slot.

6. The detachable strength training device of claim 1, wherein the removable weight assembly is removably carried on the weight bar.

7. The detachable strength training device of claim 6, wherein the removable weight assembly includes at least one weight and a weight retainer that are removably carried on the weight bar.

8. The detachable strength training device of claim 7, wherein the at least one weight includes a weight plate, having a center hole, and wherein the weight plate is carried on the weight bar via the center hole.

9. The detachable strength training device of claim 8, wherein the at least one weight includes at least two weight plates.

10. The detachable strength training device of claim 7, wherein the weight retainer includes a spring clip.

11. The detachable strength training device of claim 7, wherein the weight retainer includes a ring pin with a detent.

12. The detachable strength training device of claim 4, wherein the weight bar further includes a dumbbell section and a head, wherein the head is interposed between the second coupling and the dumbbell section and is adapted to serve as a backstop for the removable weight assembly and to space the removable weight assembly from the at least two crossbars.

13. The detachable strength training device of claim 1, wherein the peripheral frame is octagonal.

14. The detachable strength training device of claim 4, wherein the first coupling is a threaded female coupling, and wherein the second coupling is a threaded male coupling.

15. A detachable strength training device, comprising:

(a) a frame structure including:

(i) at least a top segment, a bottom segment, a left side segment, and a right sight segment, collectively forming a peripheral frame that defines a central opening, and (ii) a plurality of crossbars extending from one segment of the frame structure across the central opening to another segment of the frame structure, (iii) wherein the peripheral frame and the plurality of crossbars are co-planar with one another, (iv) wherein a plurality of grip points are provided on the peripheral frame and on the plurality of crossbars, and (v) wherein the peripheral frame and at least one crossbar are made of tubular metal and have the same cross-section as one another;

(b) a weight bar; and (c) a removable weight assembly.

16. The detachable strength training device of claim 15, wherein the peripheral frame is octagonal.

17. A detachable strength training device, comprising:

(a) a frame structure including:

(i) at least a top segment, a bottom segment, a left side segment, and a right sight segment, collectively forming a peripheral frame that defines a central opening, (ii) a plurality of crossbars extending from one segment of the frame structure across the central opening to another segment of the frame structure, and (iii) one or more resistance band retention structures, wherein the resistance band retention structures have a cross-section similar to that of the crossbars, (iv) wherein the peripheral frame and the plurality of crossbars are co-planar with one another, and (v) wherein a plurality of grip points are provided on the peripheral frame and on the plurality of crossbars;

(b) a weight bar; and (c) a removable weight assembly.

18. The detachable strength training device of claim 17, further comprising a pair of resistance bands wrapped around the one or more resistance band retention structures.

19. The detachable strength training device of claim 17, wherein the peripheral frame is octagonal.

20. A detachable strength training device, comprising:

(a) a frame structure having eight peripheral frame segments that collectively form an octagonal peripheral frame that defines a central opening, wherein each of the eight peripheral frame segments defines a grip point adapted for use by a user in gripping the device and holding the device in front of them, and wherein the eight peripheral frame segments are of approximately equal length and are joined with one another at approximately equal angles;

(b) a weight bar supported by the frame structure; and c) a removable weight assembly.

* * * * *